US008841985B2

(12) United States Patent
Feist

(10) Patent No.: US 8,841,985 B2
(45) Date of Patent: Sep. 23, 2014

(54) DEVICE FOR ELECTRICAL ISOLATION AND TOROIDAL CORE CHOKE

(75) Inventor: Guenter Feist, Gingen/Fils (DE)

(73) Assignee: Epcos AG, Munich (DE)

( * ) Notice: Subject to any disclaimer, the term of this patent is extended or adjusted under 35 U.S.C. 154(b) by 161 days.

(21) Appl. No.: 13/509,485

(22) PCT Filed: Nov. 18, 2010

(86) PCT No.: PCT/EP2010/067759

§ 371 (c)(1),
(2), (4) Date: Jul. 12, 2012

(87) PCT Pub. No.: WO2011/061258

PCT Pub. Date: May 26, 2011

(65) Prior Publication Data

US 2012/0274439 A1 Nov. 1, 2012

(30) Foreign Application Priority Data

Nov. 19, 2009 (DE) ..... 10 2009 054 001

(51) Int. Cl.
*H01F 27/28* (2006.01)

(52) U.S. Cl.
USPC ..... 336/229

(58) Field of Classification Search
USPC ..... 336/65, 90, 196, 198, 229
See application file for complete search history.

(56) References Cited

U.S. PATENT DOCUMENTS

| | | | | |
|---|---|---|---|---|
| 7,280,027 | B2 | 10/2007 | Feth et al. | |
| 7,400,224 | B2 | 7/2008 | Feist | |
| 7,479,865 | B2 * | 1/2009 | Feist et al. | 336/229 |
| 7,498,916 | B2 * | 3/2009 | Feist et al. | 336/65 |
| 7,990,248 | B2 | 8/2011 | Feist et al. | |
| 2008/0129436 | A1 * | 6/2008 | Feist et al. | 336/208 |

FOREIGN PATENT DOCUMENTS

| | | | |
|---|---|---|---|
| DE | 199 32 475 | A1 | 2/2001 |
| DE | 103 08 010 | A1 | 9/2004 |
| DE | 10 2004 048 966 | A1 | 4/2006 |
| DE | 10 2005 006 344 | A1 | 8/2006 |
| EP | 0 258 592 | A1 | 3/1988 |
| JP | 60179013 | U | 11/1985 |
| JP | 2003297650 | A | 10/2003 |
| JP | 2006518933 | A | 8/2006 |
| JP | 2008516430 | A | 5/2008 |
| JP | 2008530787 | A | 8/2008 |
| JP | 2008544503 | A | 12/2008 |
| WO | WO 2006/039876 | A1 | 4/2006 |

* cited by examiner

*Primary Examiner* — Tuyen Nguyen
(74) *Attorney, Agent, or Firm* — Slater & Matsil, L.L.P.

(57) ABSTRACT

A metallization can be used for components working with acoustic waves. The metallization includes a base having a bottom layer comprising titanium, and an upper layer comprising copper. A top layer of the metallization disposed on the base comprises aluminum.

18 Claims, 3 Drawing Sheets

DEVICE FOR ELECTRICAL ISOLATION AND TOROIDAL CORE CHOKE

This patent application is a national phase filing under section 371 of PCT/EP2010/067759, filed Nov. 18, 2010, which claims the priority of German patent application no. 10 2009 054 001.6, filed Nov. 19, 2009, each of which is incorporated herein by reference in its entirety.

TECHNICAL FIELD

The invention relates to a device for electrical isolation to be installed in a core hole of a toroidal core. The application relates, furthermore, to a toroidal core choke which has a toroidal core, a device for electrical isolation and at least two windings isolated from one another electrically by the device.

BACKGROUND

Toroidal core chokes with windings arranged on a toroidal core are commonly known. With regard to toroidal core chokes having a plurality of windings, there is in this case the fundamental problem of separating the individual windings from one another electrically.

An approach is to insulate the wires of individual windings electrically. However, this is relatively costly and leads to an increase in the space requirement.

European patent publication EP 1797572 B1 discloses a device for electrical isolation, a toroidal core choke and a method for producing a toroidal core choke. The device for electrical isolation described there comprises a middle part and three elastically deformable webs which run outward and can be wound around the middle part and which have a rigid insulating region in each case at their end facing away from the middle part. By the middle part being rotated with respect to the insulating regions, a device is adapted to the inside diameter of different toroidal cores.

In the known device, at least three webs are required for correctly positioning and securing the device. It is therefore unsuitable, in particular, for toroidal core chokes with only two windings, such as are commonly employed particularly when used in line filters.

SUMMARY

In one aspect, the present invention discloses a simple-to-produce and simple-to-mount device for electrical isolation to be installed in a core hole of a toroidal core, where the device is to be suitable for compensating tolerances in the diameter of the core hole of the toroidal core. The device is preferably also to be suitable for the stable installation in the core hole of a toroidal core having only two windings.

The following summary of refinements and detailed description of exemplary embodiments employ a cylindrical reference system to designate the different directions. In this case, the direction from the center point of a core hole toward the circumference of a toroidal core is designated as radial, the direction of the rotational axis of symmetry of the toroidal core is designated as axial, and the direction orthogonal at any point to these two directions is designated as tangential.

The device has a central region and two insulating regions projecting out of the central region in the radial direction of the core hole and movable in the radial direction. The central region has a compression zone with at least two mutually parallel first portions of two webs which couple the two insulating regions to one another mechanically. Each of the at least two first portions is deformable elastically in an S-shaped manner, the at least two first portions of the two webs being arranged parallel to one another in the expanded state of the compression zone.

Through the use of parallel first portions deformable elastically in an S-shaped manner, a radial movement of the insulating regions can be converted into a deformation of the two first portions in the region of the compression zone. The two webs which couple the two insulating regions to one another mechanically thereby cause the compression zone to be compressed in the radial direction. A device of this type can thus compensate any tolerances in the inside diameter of the toroidal core.

According to an advantageous refinement, each of the two webs has, furthermore, in each case a second portion, the at least two first portions and the two second portions of the two webs forming the sides of a parallelogram in the expanded state of the compression zone. Such a rhomboid, preferably arranged centrally, makes it possible to compress the compression zone in a kink-free manner.

According to a further advantageous refinement, the at least two first portions have a smaller material thickness than the second portions, so that, in the event of movement of the insulating regions in the radial direction, the at least two first portions are deformed in a S-shaped manner and the second portions are displaced essentially parallel to one another. The refinement described causes the compression zone to be compressed asymmetrically, thus ensuring reliable guidance of the movement of the insulating regions of the device in the radial direction.

According to an advantageous refinement, the device is formed in one piece. It can therefore be produced especially simply and cost-effectively as an injection molding.

According to a further advantageous refinement, the device has two insulating regions lying opposite one another with respect to the central region, so that the device is in the form of a longitudinally compressible web. A configuration of the device in the form of a longitudinally compressible separating web with two insulating regions lying opposite one another is suitable especially for use in toroidal core chokes with two windings, for example for a line filter with a phase conductor and with a neutral conductor.

According to a further advantageous refinement, the insulating regions project beyond a part, connected thereto, of the central region in the tangential direction of the core hole. A desired insulating distance between adjacent windings of the toroidal core can thereby be set independently of the material thickness of the device for electrical isolation in the central region.

According to a further refinement, the insulating regions have in each case a cavity. The use of a cavity makes it possible to save material during the forming of insulating regions having a relatively long insulating distance.

According to a further advantageous refinement, the device has at least one holding part with at least one latching element for latching the device to a holder for receiving the toroidal core choke. A holding part of this type makes it possible to latch the toroidal core choke on a circuit board or in a similar arrangement for mechanically fixing the toroidal core choke.

According to a further refinement, the end faces, confronting the toroidal core, of the insulating regions have nose-shaped projections for latching the toroidal core into the device. Latching the toroidal core between nose-shape projections of an end face makes it possible to fasten the device in the toroidal core securely and without any adhesive.

Aspects of the invention also provide a toroidal core choke having a toroidal core, a device for electrical isolation according to one of the abovementioned refinements and at least two windings insulated from one another electrically by the device for electrical isolation. The central region of the device for electrical isolation is tensioned by the compression zone being compressed and exerts an elastic force upon the two insulating regions in the radial direction of the toroidal core. By the device for electrical isolation being pretensioned by the compression zone being compressed, effective tolerance compensation in terms of the inside diameter of the toroidal core can be achieved.

Further advantageous refinements are given in the following detailed description of exemplary embodiments.

BRIEF DESCRIPTION OF THE DRAWINGS

The invention is explained in more detail below by means of exemplary embodiments and accompanying figures. The figures show diagrammatic illustrations, not true to scale, of various exemplary embodiments.

In these figures.

Figure 1:
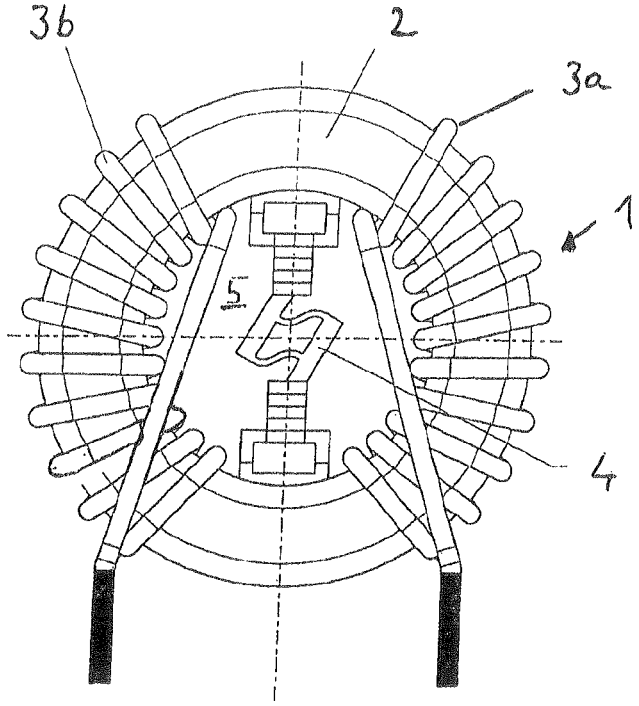
FIG. 1 shows a front view of a toroidal core choke according to a first exemplary embodiment of the invention.

The following list of reference symbols can be used in conjunction with the drawings:

1 Toroidal core choke
2 Toroidal core
3 Winding
4 Device for electrical isolation
5 Core hole
6 Insulating region
7 Central region
8 Holding part
9 Compression zone
10 Web
11 First portion
12 Second portion
13 Cavity
14 Latching element
15 Projection

DETAILED DESCRIPTION OF ILLUSTRATIVE EMBODIMENTS

FIG. 1 shows a front view of a toroidal core choke toward the plane spanned by the toroidal core of the choke.

The toroidal core choke 1 comprises a toroidal core 2 and two windings 3*a* and 3*b* insulated electrically from one another. The windings 3*a* and 3*b* are, for example, choke coils in a network supply line for a single-phase power supply network with a phase conductor and with a neutral conductor.

In order to insulate the windings 3*a* and 3*b* from one another electrically, the toroidal core choke 1 comprises, furthermore, a device 4 for electrical isolation. The device 4 is fitted into the core hole 5 of the toroidal core 2.

Figure 2:
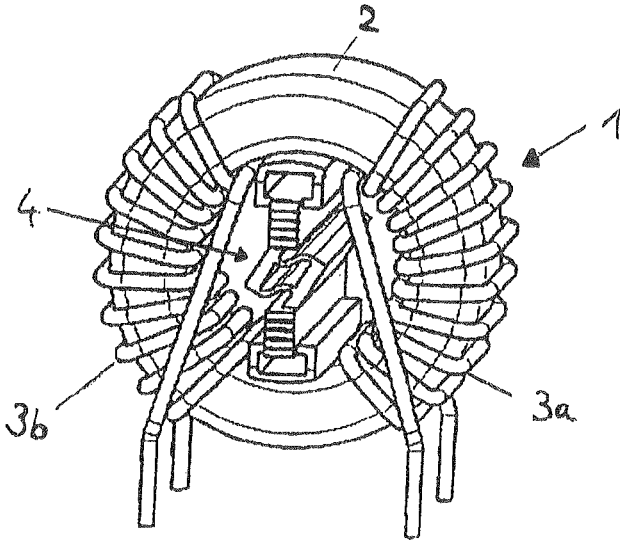
FIG. 2 shows a perspective illustration of the toroidal core choke according to FIG. 1.

FIG. 2 shows a perspective view of the toroidal core choke 1 according to FIG. 1. The exemplary embodiment is a toroidal core choke 1 to be mounted upright on a printed circuit board. The device 4 for electrical isolation described below is, of course, also suitable for the use with other forms of construction of toroidal core choke 1, in particular also for mounting horizontally.

Figure 3A:
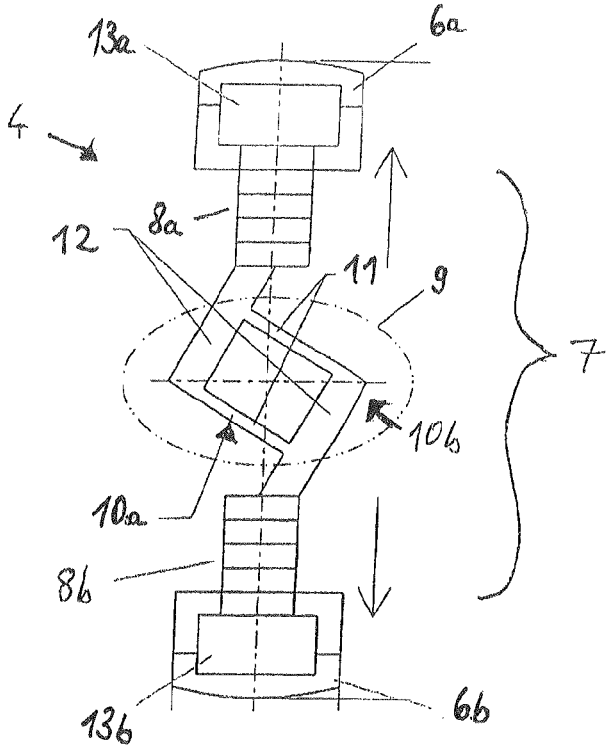
FIGS. 3A and 3B show front views of a device for electrical isolation according to the first exemplary embodiment in the expanded and the compressed state respectively.
Figure 3B:
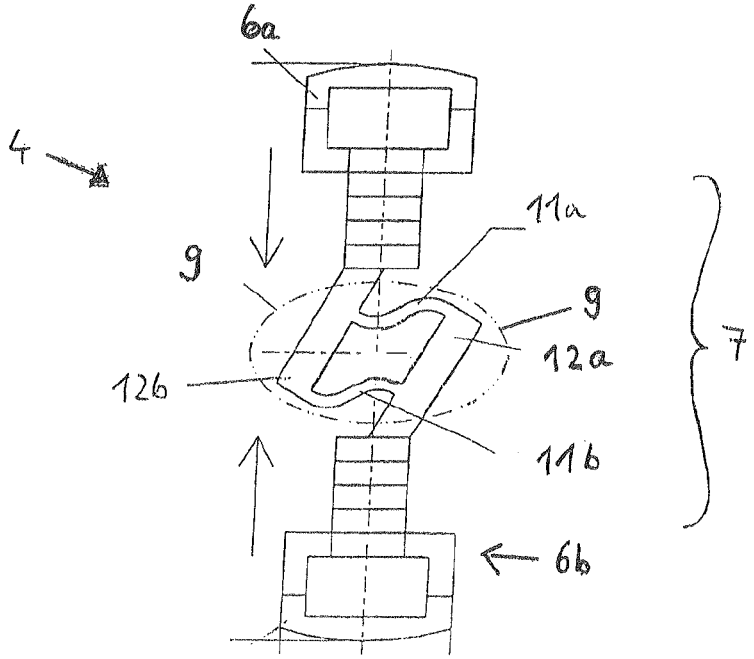

FIGS. 3A and 3B show detailed front views of the device 4 for electrical isolation according to the first exemplary embodiment in the expanded and the compressed state respectively.

The device 4 comprises in each case two insulating regions 6*a* and 6*b* respectively at the upper end or the lower end of the device 4 of a web-shaped design. The insulating regions 6*a* and 6*b* are connected to one another by means of a central region 7. In the exemplary embodiment illustrated, the central region 7 comprises in each case a holding part 8*a* and 8*b*, which respectively adjoin the insulating regions 6*a* and 6*b*, and a central compression zone 9 arranged between the holding parts 8*a* and 8*b*. The compression zone 9 can be compressed in the radial direction of the toroidal core choke 1, that is to say in the vertical direction in FIG. 3A.

For this purpose, the compression zone 9 illustrated in FIGS. 3A and 3B has two webs 10*a* and 10*b*. Each of the webs 10*a* and 10*b* respectively has a first portion 11*a* and 11*b* and a second portion 12*a* and 12*b*. The webs 10*a* and 10*b* are composed of an elastic material and can therefore be deformed under the action of force.

In the exemplary embodiment, the entire device 4 is produced as a one-piece plastic injection molding. The material used is preferably a heat-resistant and low-flammability plastic.

The webs 10*a* and 10*b*, in the state in which they are installed in the device 4, are configured point-symmetrically with respect to the center point of the device 4 and the center point of the core hole 5. Their portions 11*a*, 11*b*, 12*a* and 12*b* enclose a cavity in the projection illustrated and form a parallelogram in the expanded state illustrated in FIG. 3A. In this case, the first portions 11*a* and 11*b* have a smaller material thickness than the second material portions 12*a* and 12*b*. Consequently, the first portions 11*a* and 11*b* can be deformed elastically more easily than the second portions 12*a* and 12*b*.

By the insulating regions 6*a* and 6*b* being pressed together, for example, when the device 4 is inserted into a toroidal core 2, the central region 7 is compressed. Compression of the central region 7 in this case leads to deformation of the webs 10*a* and 10*b*, as illustrated in FIG. 3B. In this case, the first portions 11*a* and 11*b* of the webs 10*a* and 10*b* are deformed in an S-shaped manner. The second portions 12*a* and 12*b* are displaced in relation to one another in the direction of the radial axis. However, at the same time, they remain largely dimensionally stable.

To increase the spring action exerted by the compression zone 9, in a further embodiment, not illustrated, further first portions 11 deformable in an S-shaped manner are arranged between the second portions 12.

The compression illustrated in FIG. 3B has the advantage that radial compression of the insulating regions 6*a* and 6*b* leads to parallel displacement of the longitudinal axes in the region of the holding parts 8*a* and 8*b*, so that movement of the insulating regions 6*a* and 6*b* takes place predominantly in the radial direction. In particular, the central region 7 does not collapse laterally. Together with the outwardly acting force generated by the compression zone 9, this makes it possible for the device 4 having only two insulation regions 6 to be seated firmly in a toroidal core 2 of a toroidal core choke 1.

As illustrated in FIGS. 3A and 3B, the insulating regions 6 project in the tangential direction beyond the holding parts 8 of the central region 7 and thus provide a desired insulating distance between the adjacent windings 3*a* and 3*b*. In order nevertheless to make it possible to produce a device 4 simply, and so as to save material, by means of an injection molding method, the insulating regions 6*a* and 6*b* in the exemplary embodiment illustrated in each case have a cavity 13*a* and 13*b*.

Figure 4:
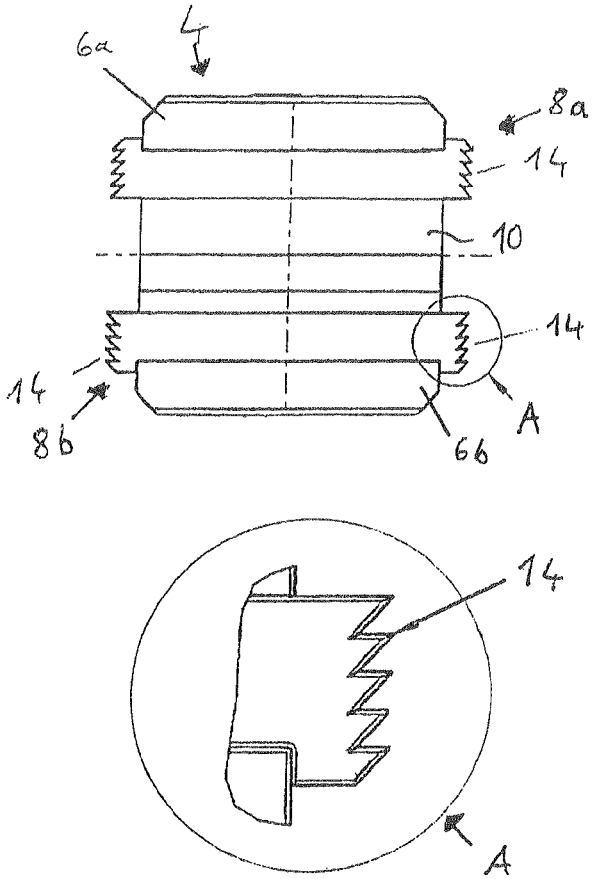
FIG. 4 shows a side view of the device for electrical isolation according to FIG. 3B.

FIG. 4 shows a side view of the device 4 toward the plane spanned by the axial and radial direction.

It can be seen in FIG. 4 that, in the exemplary embodiment, the holding parts 8 are configured on both sides with latching elements 14. The latching elements 14 in this case make it possible to latch the device 4 securely together with an essentially U-shaped holder, not illustrated in the figures, for receiving the toroidal core choke 1 on a circuit board. The latching elements 14 of the region A are illustrated enlarged in the lower part of FIG. 4.

Figure 5:
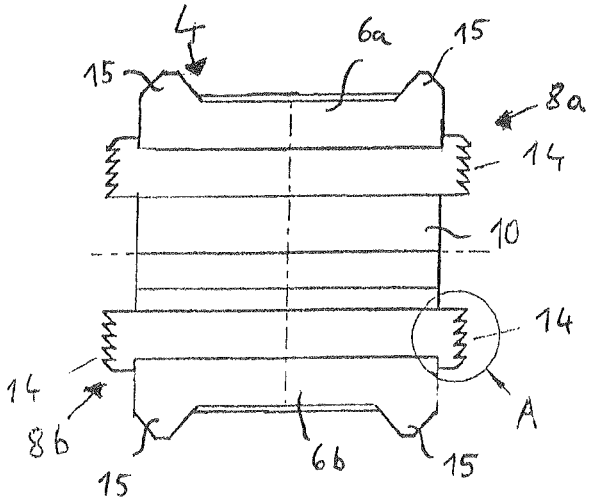
FIG. 5 shows a side view of a device for electrical isolation according to a second exemplary embodiment.

FIG. 5 shows a side view of a device 4 according to a second exemplary embodiment. The side view according to FIG. 5 also shows the plane spanned by the axial and radial direction of a toroidal core 2.

It can be seen in FIG. 5 that the insulating regions 6*a* and 6*b* according to the second exemplary embodiment have on their end faces in each case two nose-shaped projections 15 which mesh the device 4 in the inserted state together with the toroidal core 2, not illustrated in FIG. 5. In this case, the compression zone 9 exerts an elastic force upon the end faces of the insulating regions 6, which causes the toroidal core 2 to be latched into the depressions between the projections 15 and makes separate fastening, such as, for example, adhesive bonding, of the device 4 to the toroidal core 2 unnecessary.

The invention is not restricted to the exemplary embodiments illustrated in the figures and described in detail above. In particular, the configuration and number of the insulating regions can be adapted to the requirements of toroidal core chokes having different windings.

The invention claimed is:

1. A device for electrical isolation to be installed in a core hole of a toroidal core, the device comprising:

a central region having a compression zone with at least two-mutually parallel first portions of two webs; and two insulating regions projecting out of the central region in a radial direction of the core hole and movable in the radial direction;

wherein the two webs couple the two insulating regions to one another mechanically, wherein each of the first portions are deformable elastically in an S-shaped manner, and wherein the first portions of the two webs are arranged parallel to one another in the expanded state of the compression zone.

2. The device according to claim 1, wherein the two webs both include a second portion, the first portions and the second portions of the two webs forming the sides of a parallelogram in the expanded state of the compression zone.

3. The device according to claim 2, wherein each of the first portions has a smaller material thickness than the second portions of the webs, so that, in the event of movement of the insulating regions in the radial direction, the first portions are deformed in an S-shaped manner and the second portions are displaced essentially parallel to one another.

4. The device according to claim 1, wherein the device is formed in one piece.

5. The device according to claim 1, wherein the two insulating regions lie opposite one another with respect to the central region, so that the device is in the form of a longitudinally compressible web.

6. The device according to claim 1, wherein the insulating regions project beyond a part of the central region connected to the insulating regions in a tangential direction of the core hole.

7. The device according to claim 1, wherein the insulating regions each have a cavity.

8. The device according to claim 1, further comprising a holding part with at least one latching element for latching the device to a holder for receiving the toroidal core choke.

9. The device according to claim 1, wherein end faces of the insulating regions have nose-shaped projections for latching the toroidal core into the device.

10. A toroidal core choke, comprising:

a toroidal core;

a device for electrical isolation, the device comprising a central region having a compression zone with at least two mutually parallel first portions of two webs and two insulating regions projecting out of the central region in a radial direction of the core hole and movable in the radial direction, wherein the two webs couple the two insulating regions to one another mechanically, wherein each of the first portions are deformable elastically in an S-shaped manner, and wherein the first portions of the two webs are arranged parallel to one another in the expanded state of the compression zone; and at least two windings insulated from one another electrically by the device for electrical isolation, the central region of the device for electrical isolation being tensioned by the compression zone being compressed, wherein the central region exerts an elastic force upon the two insulating regions in the direction of the toroidal core.

11. The toroidal core choke according to claim 10, wherein the two webs both include a second portion, the first portions and the second portions of the two webs forming the sides of a parallelogram in the expanded state of the compression zone.

12. The toroidal core choke according to claim 11, wherein each of the first portions has a smaller material thickness than the second portions of the webs, so that, in the event of movement of the insulating regions in the radial direction, the first portions are deformed in an S-shaped manner and the second portions are displaced essentially parallel to one another.

13. The toroidal core choke according to claim 10, wherein the device is formed in one piece.

14. The toroidal core choke according to claim 10, wherein the two insulating regions lie opposite one another with respect to the central region, so that the device is in the form of a longitudinally compressible web.

15. The toroidal core choke according to claim 10, wherein the insulating regions project beyond a part of the central region connected to the insulating regions in a tangential direction of the core hole.

16. The toroidal core choke according to claim 10, wherein the insulating regions each have a cavity.

17. The toroidal core choke according to claim 10, wherein the device for electrical isolation further comprises a holding part with at least one latching element for latching the device to a holder for receiving the toroidal core choke.

18. The toroidal core choke according to claim 10, wherein end faces of the insulating regions have nose-shaped projections for latching the toroidal core into the device.

* * * * *

UNITED STATES PATENT AND TRADEMARK OFFICE

CERTIFICATE OF CORRECTION

PATENT NO. : 8,841,985 B2
APPLICATION NO. : 13/509485
DATED : September 23, 2014
INVENTOR(S) : Guenter Feist It is certified that error appears in the above-identified patent and that said Letters Patent is hereby corrected as shown below:

On the Title page, item (57) Abstract, replace the abstract with: --A device to be installed in a core hole of a toroidal core provides electrical isolation. A central region has a compression zone with at least two mutually parallel first portions of two webs. Two insulating regions project out of the central region in a radial direction of the core hole and is movable in the radial direction. The two webs couple the two insulating regions to one another mechanically. Each of the first portions are deformable elastically in an S-shaped manner. The first portions of the two webs are arranged parallel to one another in the expanded state of the compression zone.--

Signed and Sealed this
Thirteenth Day of October, 2015

Michelle K. Lee

Michelle K. Lee
*Director of the United States Patent and Trademark Office*